US009111438B2

(12) United States Patent
McGinn et al.

(10) Patent No.: US 9,111,438 B2
(45) Date of Patent: Aug. 18, 2015

(54) APPARATUS, SYSTEMS AND METHODS FOR LOW POWER DETECTION OF MESSAGES FROM AN AUDIO ACCESSORY

(71) Applicant: BLACKBERRY LIMITED, Waterloo (CA)

(72) Inventors: John Douglas McGinn, Cambridge (CA); Jens Kristian Poulsen, Kitchener (CA)

(73) Assignee: BLACKBERRY LIMITED, Waterloo (CA)

( * ) Notice: Subject to any disclaimer, the term of this patent is extended or adjusted under 35 U.S.C. 154(b) by 145 days.

(21) Appl. No.: 13/779,742

(22) Filed: Feb. 28, 2013

(65) Prior Publication Data

US 2014/0241130 A1 Aug. 28, 2014

(51) Int. Cl.

| | |
|---|---|
| ***G08C 23/02*** | (2006.01) |
| ***H04R 3/00*** | (2006.01) |
| ***G10G 7/02*** | (2006.01) |
| ***G08C 17/02*** | (2006.01) |

(52) U.S. Cl.

CPC ..... *G08C 17/02* (2013.01); *G08C 2201/112* (2013.01); *G08C 2201/114* (2013.01); *G08C 2201/30* (2013.01)

(58) Field of Classification Search

CPC ..... G08C 23/02

USPC ..... 340/533; 455/89, 90, 425; 381/77, 123, 381/355

See application file for complete search history.

(56) References Cited

U.S. PATENT DOCUMENTS

| | | | | |
|---|---|---|---|---|
| 5,392,313 | A * | 2/1995 | Noro | 375/211 |
| 5,409,445 | A * | 4/1995 | Rubins | 600/27 |
| 5,628,056 | A * | 5/1997 | Grysiewicz et al. | 455/74 |
| 6,671,494 | B1 * | 12/2003 | James | 455/66.1 |
| 7,623,667 | B2 * | 11/2009 | Sander et al. | 381/74 |
| 7,983,722 | B2 * | 7/2011 | Lowles et al. | 455/575.2 |
| 2004/0203975 | A1 * | 10/2004 | Chen et al. | 455/517 |
| 2005/0201568 | A1 * | 9/2005 | Goyal | 381/74 |
| 2008/0039072 | A1 * | 2/2008 | Bloebaum | 455/425 |
| 2012/0257768 | A1 * | 10/2012 | Park et al. | 381/94.5 |
| 2012/0257776 | A1 * | 10/2012 | Ozcan | 381/345 |
| 2013/0223641 | A1 * | 8/2013 | Lin et al. | 381/77 |
| 2014/0016803 | A1 * | 1/2014 | Puskarich | 381/309 |

* cited by examiner

*Primary Examiner* — Nam V Nguyen

(74) *Attorney, Agent, or Firm* — Perry + Currier Inc.

(57) ABSTRACT

According to one aspect, an electronic device adapted to be controlled by an audio accessory. The electronic device includes at least one resonator. Each resonator is tuned to respond to a particular frequency that corresponds to a particular message generated by the audio accessory. When the particular message is received, the corresponding resonator resonates to generate an output signal that controls the electronic device.

20 Claims, 8 Drawing Sheets

APPARATUS, SYSTEMS AND METHODS FOR LOW POWER DETECTION OF MESSAGES FROM AN AUDIO ACCESSORY

FIELD

Embodiments herein relate to electronic devices and in particular to apparatus, systems and methods for low power detection of messages from an audio accessory, for example control messages sent for controlling an electronic device.

INTRODUCTION

Electronic devices, including portable electronic devices like smart phones, have gained widespread use and may provide a variety of functions including telephonic services, text messaging and other data applications, playing media such as music and movies, and so on.

Electronic devices are often used with audio accessories such as microphones, standalone speakers, headsets or headphones (for purposes of illustration and explanation, audio accessories may be illustrated herein as headsets or headphones). Audio accessories may receive audio information from the electronic device, or transmit to the electronic device audio information. This audio information may include any signals related to audio, such as voice or music or other sounds, and instructions, messages, control codes or other data related to the audio. For example, some electronic devices have audio jacks that are sized and shaped to receive a mating plug from a headset. A user connects the headset to the electronic device by inserting the plug on the headset into the audio jack on the electronic device. Once connected, audio can be output to the user via speakers on the audio accessory.

In some electronic devices, audio accessories may incorporate a microphone to allow audio signals (e.g., speech) to be sent from the audio accessory to the electronic device. This may allow the user to make phone calls through the audio accessory, record voice memos, control the electronic device using voice commands, and so on.

An audio accessory may include one or more buttons or other input devices to control the electronic device. For example, buttons may be used to increase or decrease audio volume, answer an incoming phone call, play or pause music playback, and so on.

DRAWINGS

For a better understanding of the embodiments described herein, and to show how they may be carried into effect, reference will now be made, by way of example, to the accompanying drawings.

DESCRIPTION OF VARIOUS EMBODIMENTS

Figure 1:
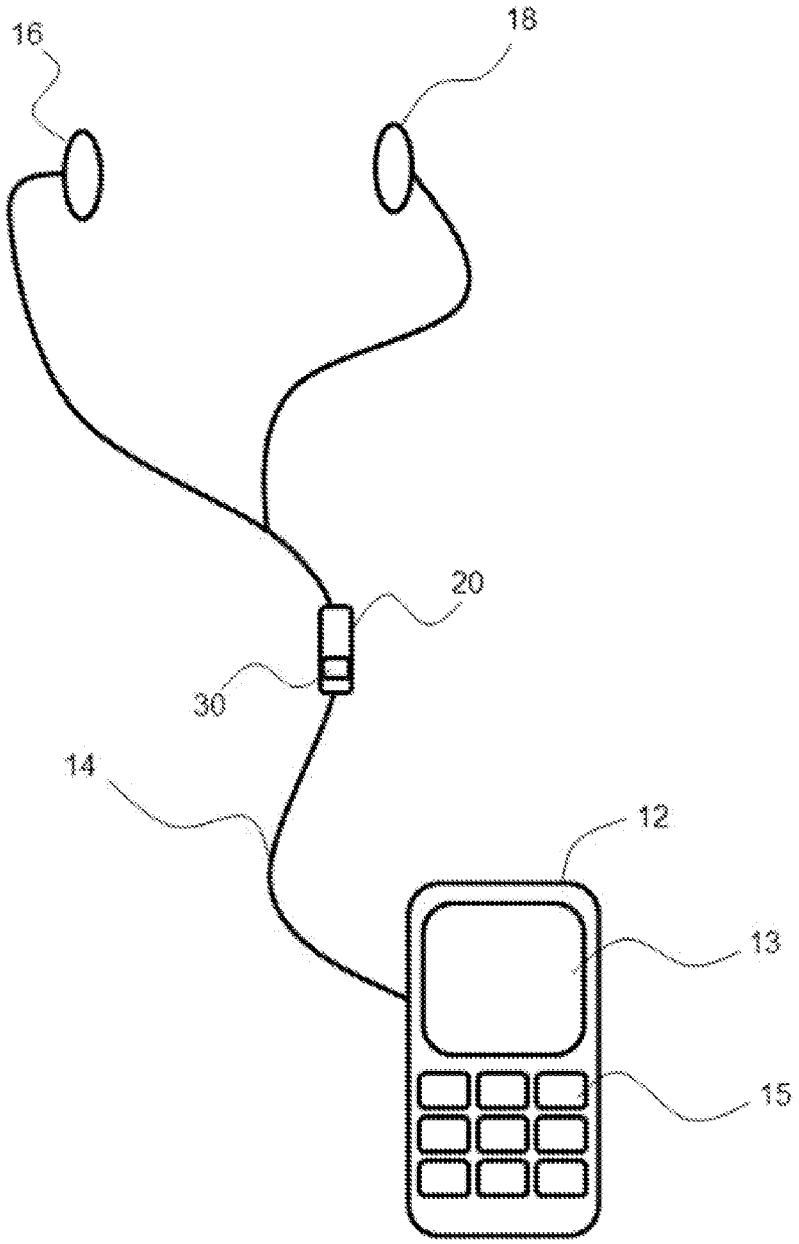
FIG. 1 is a schematic representation of an electronic device and an audio accessory according to one embodiment.

Generally, some embodiments as described herein may be implemented on electronic devices, which may include a wide range of portable devices that can be worn or carried by a human user, such as mobile phones, smart phones, personal digital assistants (PDAs), notebooks, laptops, digital audio/video players, digital audio/video recorders, tablet computers, and so on. The devices may be handheld, that is, sized and shaped to be held and carried in a human hand (although some handheld devices may be attached to clothing or otherwise worn during use). In some appropriate cases, however, the electronic devices may include devices that are normally not worn or carried by a human user, for example a desktop computer, a stereo system, a vehicle audio system, and so on.

On some of these electronic devices, especially portable electronic devices, computer resources (e.g., memory capacity, processing power, battery life and screen space) may be more limited than on other devices. A portable smart phone, for example, may have a smaller display, less memory capacity and much more limited power available than a desktop computer.

According to one aspect, the teachings herein describe a system for controlling an electronic device, the system comprising an audio accessory coupled to the electronic device, the audio accessory having a tone generator and a user control interface for receiving at least one input, the accessory adapted to, in response to an input, generate a corresponding message at a particular frequency using the tone generator, and send that message to the electronic device, the electronic device being operable to receive the message, and including at least one resonator adapted to resonate at the particular frequency and to generate a corresponding output signal, and wherein the output signal causes an appropriate action to be executed on the electronic device.

In some cases, the particular frequency may be selected so as to be inaudible to a human user. For example, the particular frequency may be an ultrasonic frequency.

In some embodiments, each resonator includes a passive resonating element. For example, the passive resonating element may include a LC filter or another suitable resonating element.

In some embodiments, the system may include a filter that may be adapted to filter the message received by the resonating element.

In some embodiments, the system may include a voltage comparator adapted to receive the output signal of the resonating element. The voltage comparator may compare the output signal of the resonating element with a reference voltage to generate the output signal.

In some embodiments the output signal of the resonator drives an interrupt line on a processor.

In some embodiments, the output signal is adapted to wake at least one component of the electronic device from a low power state.

In some embodiments, the at least one resonator includes a plurality of resonators, each resonator tuned to respond to a different frequency indicative of a different particular message.

In some embodiments, each particular message includes a header message and a control message. In some embodiments, the resonator is adapted to resonate in response to the header message to activate a secondary detection circuit that responds to the control message. In some cases, the electronic device is adapted to operate in a low power mode until the header message is detected, and then in a higher power mode to detect the control message. In some cases, the header message has a constant frequency for each message, and the control message frequencies vary for different control messages.

According to another aspect, the teachings here are directed to an electronic device adapted to be controlled by an audio accessory, comprising at least one resonator, each resonator tuned to respond to a particular frequency that corresponds to a particular message generated by the audio accessory such that when the particular message is received, the resonator resonates to generate an output signal that controls the electronic device. Each resonator may include a passive resonating element, for example, a LC filter.

In some embodiments, the electronic device may include a filter adapted to filter the message received by the resonating element.

In some embodiments, the electronic device may include a voltage comparator adapted to receive the output signal of the resonating element.

The concepts as described herein are not necessarily limited to any particular kind of electronic device, but in some appropriate cases may be suitable for use on various electronic devices with various computer resources, particularly where power consumption is a concern.

In some embodiments, the electronic device may be a portable electronic device, such as a smart phone, that has communications capabilities (e.g., voice or data, or both) over one or more data connections (e.g., a wireless connection), and which is adapted to cooperate with an audio accessory (e.g., headphones).

In this disclosure, elements may be described as "adapted to" perform or "adapted for" performing one or more functions. In general, an element that is adapted to perform a function is suitable for performing the function, or is configured to perform the function, or is operable to perform the function, or is otherwise capable of performing the function.

In some cases it may be desirable to control one or more aspects of the portable electronic device using an audio accessory. For example, it may be desirable to control options such as audio volume, playing or pausing audio output, selecting different music tracks, answering an incoming call, and so on, using the audio accessory.

In some embodiments, an audio accessory may include one or more input devices (e.g., buttons, which could be physical buttons or keys, a touchscreen, etc.) that can be used to generate and send messages for controlling the electronic device. In general, these messages may be sent between the audio accessory and the electronic device over a wired audio jack (e.g., a TRS or TRRS jack).

Some control schemes allow an audio accessory to control an electronic device by shorting buttons on a microphone line. However, this approach tends to interfere with the audio signals and produce undesirable audio artifacts (e.g., audible pops or clicks).

In some instances, to avoid undesirable audio artifacts, control messages can be sent using tones that are inaudible to the user. For example, control tones can be selected with a frequency that is outside the normal human audible frequency range (e.g., below 20 Hz or above 20 kHz). In particular, ultrasonic tones with a frequency of more than 20 kHz may be used to send control messages. For example, techniques for sending and receiving ultrasonic tones between an audio accessory and an electronic device are discussed in U.S. patent application Ser. No. 13/309,099 to Poulsen and McGinn, the entire contents of which are hereby incorporated by reference herein.

Sending ultrasonic tones from an audio accessory to an electronic device generally requires that the electronic device actively monitor the audio jack to "listen" for the tones. Otherwise a particular control message may be missed. To accomplish this, some electronic devices use a high frequency clock (e.g., in the MHz range) that regularly runs detection circuitry to monitor the audio jack for ultrasonic tones. Such circuitry may be operable to discriminate between ultrasonic tones over a wide frequency range (e.g., between about 90 kHz to 300 kHz).

Since it may be possible for a user to send control messages at various times that tend to be unpredictable, many electronic devices will continuously monitor the audio jack for incoming control messages whenever the electronic device is powered on. As a result, such electronic devices tend to constantly be consuming power. This can have a negative effect on battery life, which is undesirable, particularly when the electronic device is operating in a low power mode. For example, an electronic device may be operating in a low power audio (LPA) mode where many components and other power-consuming elements are deactivated to extend battery life. Continuously monitoring for control messages can increase the power consumption of the electronic device and reduce battery life.

Some of the embodiments herein may be useful for detecting messages sent from an audio accessory to an electronic device (particularly control messages), while consuming at least somewhat less power as compared to other techniques.

According to one embodiment, an electronic device may include at least one resonator. Each resonator may be tuned to respond to a particular frequency that corresponds to a frequency of a particular signal (e.g., a control message) sent from the audio accessory to the electronic device. When that particular signal is received, the corresponding resonator will resonate and generate an output signal. This output signal can then be used to control the electronic device, for example, by waking up a processor.

In one exemplary embodiment, each resonator may include a passive resonating element having a passive high order LC filter (inductor-capacitor filter) with a high Q factor (e.g., low damping). Each resonating element will be tuned to resonate when exposed to a specific ultrasonic frequency that corresponds to a particular signal generated by the accessory.

In some embodiments, one or more of the resonators could include a low drop diode detector, such as a germanium or Schottky diode or active rectifier.

In some embodiments, noise and other undesired frequencies (e.g., audio frequencies other than the frequency of the message) can be filtered (e.g., using one or more filters) before the message is sent to the resonating element. This can be useful to help inhibit erroneous results, for instance where background noise could be interpreted as an actual message.

In some embodiments, the resonator can include a voltage comparator. When the resonating element resonates in response to the received message, it generates an output voltage. This output voltage may then be applied to an input (e.g., the positive input) of the voltage comparator (e.g., an ultra-low power voltage comparator), while the other input of the voltage comparator (e.g., the negative input) is coupled to a reference voltage (e.g., 10 mV).

In general, the reference voltage should be selected such that, when the resonator receives the particular message and resonates, the output voltage from the resonating element will exceed the reference voltage. This will cause the voltage comparator output to switch from a default state (e.g., a low state) to another state (e.g., a high state).

In some embodiments, the output from the voltage comparator could be used to cause the electronic device to take some action. For instance, the comparator output could drive an interrupt line on a processor, causing the processor to wake up and run a particular interrupt service routine (e.g., increasing or decreasing the volume, beginning audio playback, etc.).

In general, the resonator may be a passive circuit that does not require active power. Thus, the resonator can operate when the electronic device is in a low power mode (e.g., when the processor is in a sleep state). Furthermore, the resonator can operate without the need for a high frequency clock or detection circuitry that would otherwise be needed to actively monitor for control messages. This should help reduce the power consumption of the electronic device.

In some embodiments, the messages sent by an audio accessory to the electronic device may have two parts: a header message and a control message. In some cases, the header message could be a generic indicator that some control message will be sent shortly thereafter (e.g., a preamble), while the control message includes the actual instructions to the electronic device (e.g., an instruction to increase audio volume, etc.). In some cases, the header message may be the same for each control message while the control message may vary.

In some such embodiments, the electronic device may include a resonator that is adapted to detect the header message and then activate a secondary detection circuit that can process the control message. In particular, the frequency of the header message may be the same for each message, but the control message frequency might vary. The resonator may be highly suited for detecting the presence of a particular constant header message (while generally using little or no power), while a secondary detection circuit may be better suited for distinguishing between the different frequencies of different control messages (although the secondary detection circuit may consume more power).

In this manner, the electronic device may be able to operate in a low power mode until the header message is detected, and then switch into a higher power mode (activating the secondary detection circuit) when the electronic device expects a control message to be forthcoming.

In one specific example, a message could include a header message at a specific ultrasonic tone (e.g., 260 kHz) that indicates that a control message will be sent. The header message will then be followed by a control message that could be at various frequencies (e.g., any frequency from 50 kHz to 500 kHz) depending on what particular instructions are being sent to the electronic device. The resonator can be tuned to resonate when exposed to an ultrasonic tone at 260 kHz, indicating that a secondary detection circuit should be powered up to receive the forthcoming control message.

In some embodiments, an electronic device might include a plurality of resonators. Each resonator may be adapted to respond to a different particular frequency that could be indicative of a different message. This approach may be particularly advantageous where no header messages are used.

For example, a first control message may be a tone at 100 kHz that indicates that the audio volume should be increased, while a second control message could be a tone at 150 kHz that indicates that audio volume should be decreased. A first resonator could be operable to resonate at 100 kHz, while a second resonator could be operable to resonate at 150 kHz. In such cases, each resonator may be operable to drive a different interrupt line on a processor such that the processor can automatically receive a different interrupt signal depending on the frequency of the tone.

In this way, the electronic device may be operable to detect different control messages at different frequencies without an active frequency detection circuit.

In some such cases, the same reference voltage could be used for the voltage comparator of each resonator, although in other cases a different reference voltage could be used.

In some embodiments, instead of using a reference voltage and voltage comparator, a low drop diode detector such as a germanium or Schottky diode or active rectifier could be used. This may help to reduce power consumption even further.

Since the voltage comparator output would generally always be in either the high or low state, the current consumption could be very low. Accordingly, no pull-up resistor to the interrupt line should be required. This may make the circuit less expensive to implement, and could further reduce the power requirements.

Reference is now made to FIG. 1, which is a schematic diagram illustrating an electronic device 12 and an audio accessory 14 according to one embodiment.

The electronic device 12 may include any suitable electronic device, such as a portable smart phone having a display 13 and a physical keyboard 15. In some embodiments, the electronic device 12 may include a touchscreen device, optionally with or without the keyboard 15.

In this embodiment the audio accessory 14 is a headset having two speakers (e.g., speakers 16, 18), although in other embodiments a different number of speakers could be present. The speakers 16, 18 of the audio accessory 14 are generally operable to output audio content, such as music, speech, and so on.

The audio accessory 14 also includes a user control interface 20 that functions to receive one or more inputs from a user, and that includes at least one input device operable for controlling aspects of the electronic device 12 (e.g., audio volume, changing music tracks, etc.) using one or more input devices.

In some embodiments, the audio accessory 14 may include a microphone 30 for receiving audio signals (e.g., a user's voice) and for sending those audio signals to the electronic device 12. As shown, in some embodiments the microphone 30 may be provided as part of the user control interface 20.

In some embodiments, the audio accessory 14 is connected to the electronic device 12 using a conventional audio plug on the accessory 14 that mates with a corresponding audio jack on the electronic device 12. In some embodiments, the plug and jack can be of the tip-ring-sleeve (TRS) variety, a tip-ring1-ring2-sleeve (TRRS) variety, or other various types. For example, some audio connectors are in the form of 3.5 mm (⅛") miniature plugs and jacks, or other sizes such as 2.5 mm connectors and ¼" connectors. In headsets and other audio accessories, these audio connectors may be used to carry audio signals, control messages, and other audio information between the speakers 16, 18, the microphone 30 and the electronic device 12.

Figure 2:
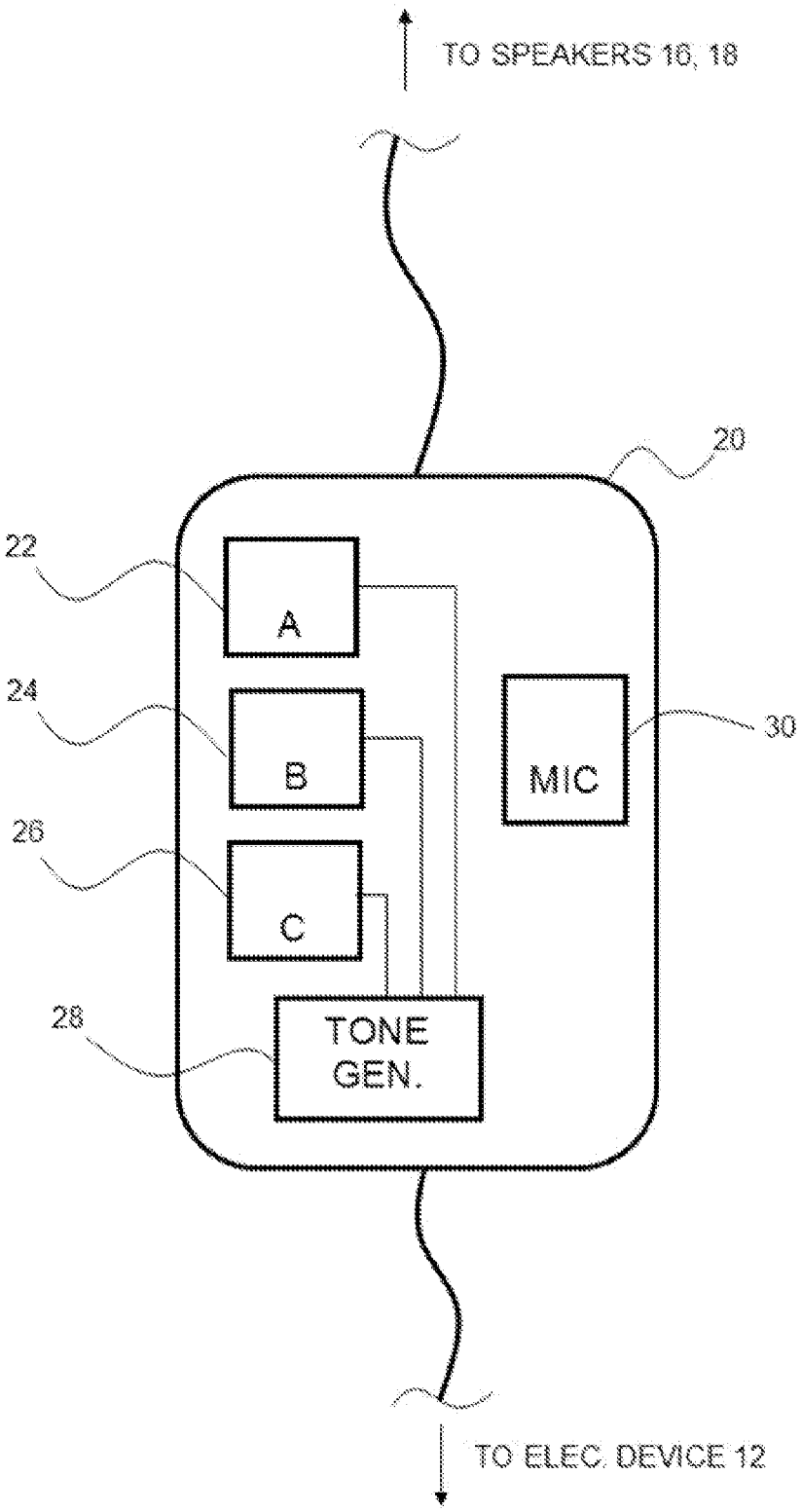
FIG. 2 is a schematic representation of a user control interface for the audio accessory of FIG. 1.

As shown in FIG. 2, the user control interface 20 may include one or more buttons, such as a first button 22, a second button 24 and a third button 26. When a user provides one or more inputs to the audio accessory 14 using the user control interface 20 (e.g., by pressing one or more of the buttons 22, 24, 26), a message will be sent to the electronic device 12 to direct the electronic device 12 to take (or execute) an appropriate action (e.g., increase or decrease volume, answer an incoming telephone call, etc.). Appropriate action is a response to an input. Colloquially speaking, executing an appropriate action typically pertains to carrying out the user's command as expressed by the input received via the user control interface 20.

As shown, the audio accessory 14 also includes a tone generator 28 for sending control signals to the electronic device 12. The tone generator 28 is in communication with the buttons 22, 24, and 26. When a user makes an input (e.g., by pressing one or more of the buttons 22, 24, 26), the tone generator 28 detects that input and generates a corresponding message (which may also be called a corresponding control message or a control message that corresponds to the input, and which in some cases may be preceded by a header message). This control message (and header message where applicable) is then sent to the electronic device 12 (e.g., via the audio jack).

In some embodiments, the audio accessory 14 may be powered by the electronic device 12 via a DC microphone bias that is generally continuously available while the audio accessory 14 is coupled to the electronic device 12 (e.g., via the audio jack). The audio accessory 14 may be configured to draw little or no power unless and until a button (e.g., one of buttons 22, 24, or 26) is activated on the audio accessory 14. Then, when a button is pressed the audio accessory 14 will draw power, wake up, and then generate the message.

In some embodiments, the control message has a frequency that is selected so as to be inaudible (which may include control messages that are totally outside the range of human hearing as well as control messages that are substantially inaudible or that have negligible audibility) to a user of the audio accessory 14. For example, the control message may comprise an ultrasonic tone that is above the hearing range of an average human (e.g., above 20 kHz). As such, the control message may be referred to as an "out-of audible band" control message. By sending control messages to the electronic device 12 that are out-of-audible band, undesirable audio artifacts can generally be avoided.

In other embodiments, other control messages may be used (e.g., in-audible band tones may be used although these may tend to produce undesirable audio effects). In some cases, different techniques may be used for suppressing any undesirable audio artifacts.

Generally, the particular frequency of the control message may be selected depending on the particular input selected (e.g. which button 22, 24, 26 was pressed). For example, the first button 22 may generate a first control message with a tone at 94 kHz to indicate that the audio volume should be increased, while the second button 24 may generate a second control message with a tone at 160 kHz to indicate that audio volume should be decreased. Particular frequencies that correspond to particular inputs may be, but need not be, strictly pure tones.

Furthermore, the frequency of the control message may be selected so that the user will generally not perceive the control message. Accordingly, the user may control the electronic device 12 using the audio accessory 14 even when using the audio accessory 14 for another purpose (such when participating in a telephone call) generally without experiencing undesirable audio effects.

In some embodiments, the control message may be preceded by (or otherwise associated with) a header message that is indicative that a control message will be forthcoming. As described above, the header message may be a tone at a generally constant frequency (e.g., 260 kHz) regardless of the frequency of the control message.

Figure 3:
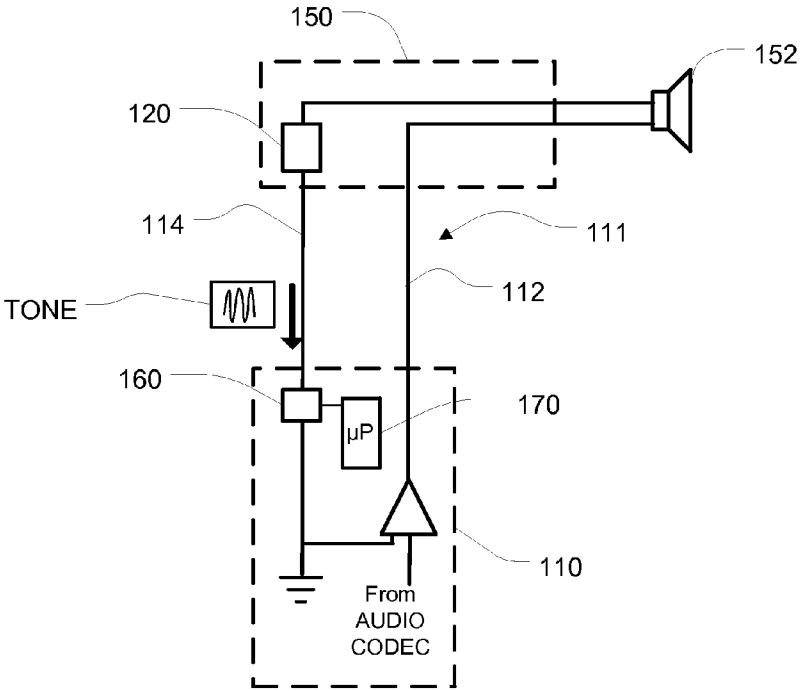
FIG. 3 is a schematic representation of an electronic device and audio accessory according to another embodiment.

Turning now to FIG. 3, illustrated therein is an electronic device 110 and audio accessory 150 according to one embodiment. As discussed generally above, the electronic device 110 is adapted to detect a message sent by the audio accessory 150 via an audio jack 111.

Similar to as in FIG. 1, the audio accessory 150 includes one or more speakers, for example speaker 152. The audio accessory 150 also includes a control interface 120 that includes a tone generator.

In this embodiment, the control interface 120 is adapted to generate ultrasonic tones on a microphone signal line 114 of the audio jack 111, although in other embodiments the ultrasonic tones could be generated on an audio line 112 or over another connection between the electronic device 110 and the accessory 150.

As shown, the electronic device 110 includes at least one resonator 160. As discussed above, each resonator 160 is tuned to respond to a particular frequency that corresponds to the particular frequency of a signal or message generated by the accessory 150. When that particular message is received, the resonator 160 will resonate and generate an output signal that can then be used to control the electronic device 110. For example, as shown the resonator 160 is coupled to a processor 170. When the resonator 160 resonates, the resulting output signal may control the operation of the processor 170, for example by driving an interrupt line.

Figure 4:
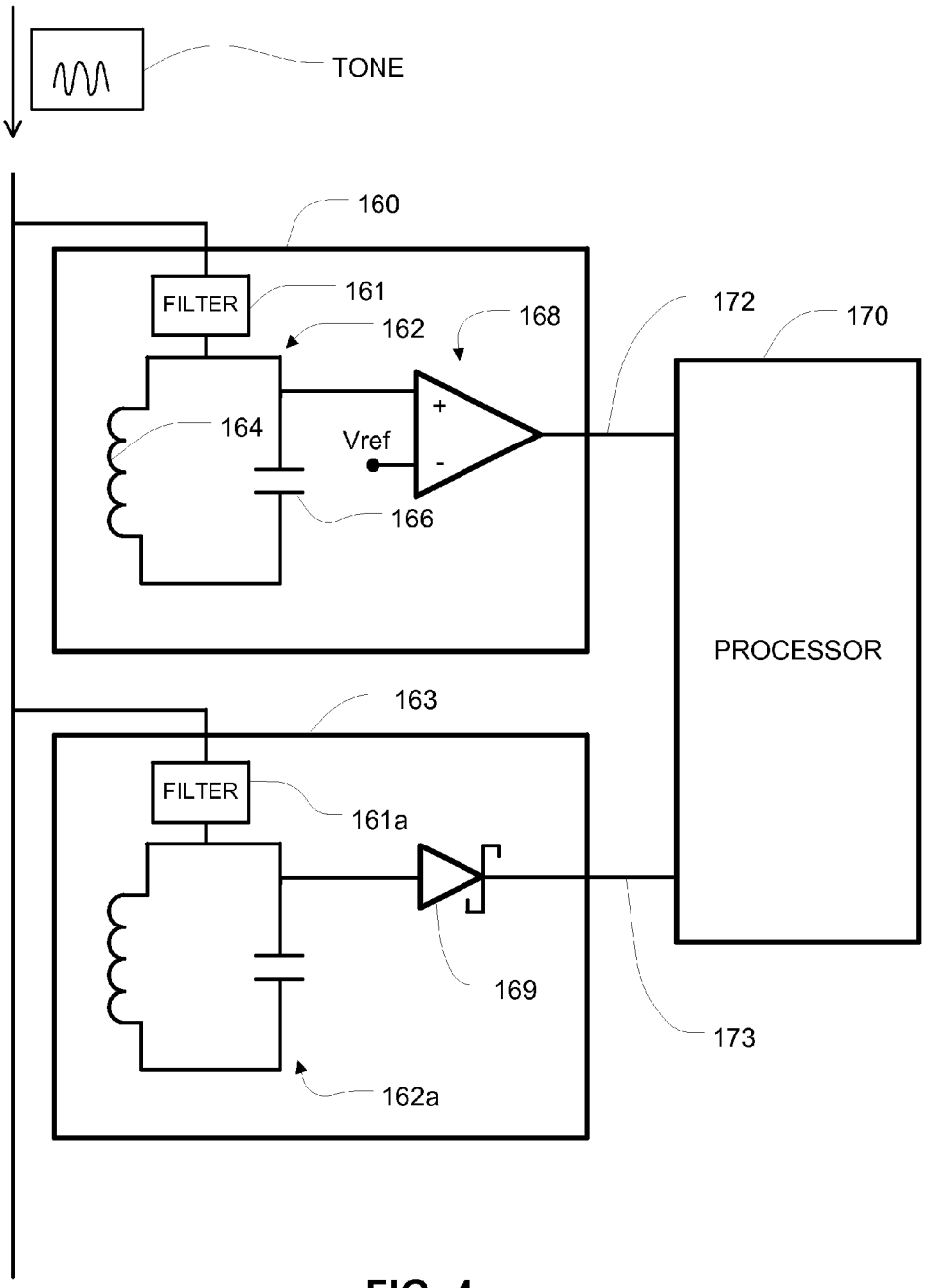
FIG. 4 is a schematic representation of resonators coupled to a processor on the electronic device of FIG. 3.

Turning now to FIG. 4, as shown an electronic device 110 may include a plurality of resonators, including the first resonator 160 and a second resonator 163.

The first resonator 160 generally includes a resonating element 162 that is adapted to resonate at a particular frequency (e.g., 100 kHz). In some embodiments, a filter 161 may be located before the resonating element 162 to improve the quality of the signal being received by the resonating element 162 (e.g., removing unwanted noise or other audio).

In this embodiment, the resonating element 162 is an LC circuit having an inductor 164 and a capacitor 166. Generally, the properties of the inductor 164 and capacitor 166 should be selected to encourage oscillation of the resonating element 162 according to the following equation:

$$f = \frac{1}{2\pi\sqrt{LC}}$$

where f is the resonant frequency of the resonating element 162 (in Hz), L is the inductance of the inductor 164 (in henries), and C is the capacitance of the capacitor 166 (in farads).

Besides simple LC circuits, there are many other kinds of circuits that can function as resonating elements, and the concept is not restricted to any particular circuitry. In some embodiments, ceramic or crystal resonators may be suitable as resonating elements.

As shown, the first resonator 160 also includes a voltage comparator 168, with the output of the resonating element 162 coupled to the positive input of the voltage comparator 168. The negative input of the voltage comparator 168 is coupled to a reference voltage (e.g., 10 mV).

In general, the reference voltage may be selected so that when the resonating element 162 is exposed to a particular message with a particular frequency, the output voltage of the resonating element 162 will exceed the reference voltage, causing the voltage comparator 168 output to switch from a low state to a high state. More particularly, the voltage should be at least the guaranteed minimum logic "1" threshold voltage for the particular configuration of the processor 170 on the electronic device 110.

The output from the voltage comparator 168 can then be used to instruct the electronic device 110 to take some action. For example, in this embodiment the output from the voltage comparator 168 drives an interrupt line 172 on the processor 170. When this resonator 160 resonates, this may be used to wake up the processor 170, reduce the audio volume, begin audio playback, and so on.

As discussed above, in some embodiments the message from the audio accessory 150 includes a header message and a control message. In some such cases, upon receipt of a header message the resonator 160 may cause the processor 170 to power up a secondary detection circuit that is adapted to interpret the control message. Since this secondary circuit may be an active circuit, it may be better suited at detecting and distinguishing between different control messages at different frequencies (although it may use more power than the resonator).

As generally described above, in some embodiments the first resonator 160 and second resonator 163 may be tuned to respond to different particular frequencies. For example, the resonating element 162 of the first resonator 160 may resonate at a first frequency (e.g., 100 kHz), while the second resonator 163 has a different resonating element 162*a* that will resonate at a different frequency (e.g., 150 kHz, since the inductance and capacitive values may be different).

Furthermore, in some embodiments the second resonator 163 may include a filter 161*a* adapted to filter different frequencies as compared to the filter 161 in the first resonator 160.

As shown in FIG. 4, in some embodiments one of the resonators (e.g. the second resonator 163) may include a resonating element 162*a* that is coupled to a Schottky diode 169 instead of to a voltage comparator. This alternative approach may help further reduce the power consumption of the second resonator 163. More particularly, in such cases, where the excitation of the resonating element 162*a* exceeds the forward threshold of the Schottky diode 169, the processor interrupt line 173 will be drive to a voltage level sufficiently highs to switch the logic state of the interrupt line 173 from a "0" to a "1". In some cases, this technique may generate multiple interrupts if the signal is not processed further using any hardware. However, it should be possible for the processor interrupt service routine to be adapted to ignore such multiple interrupts.

In some other embodiments, a germanium diode could be used in place of the Schottky diode 169.

Figure 5:
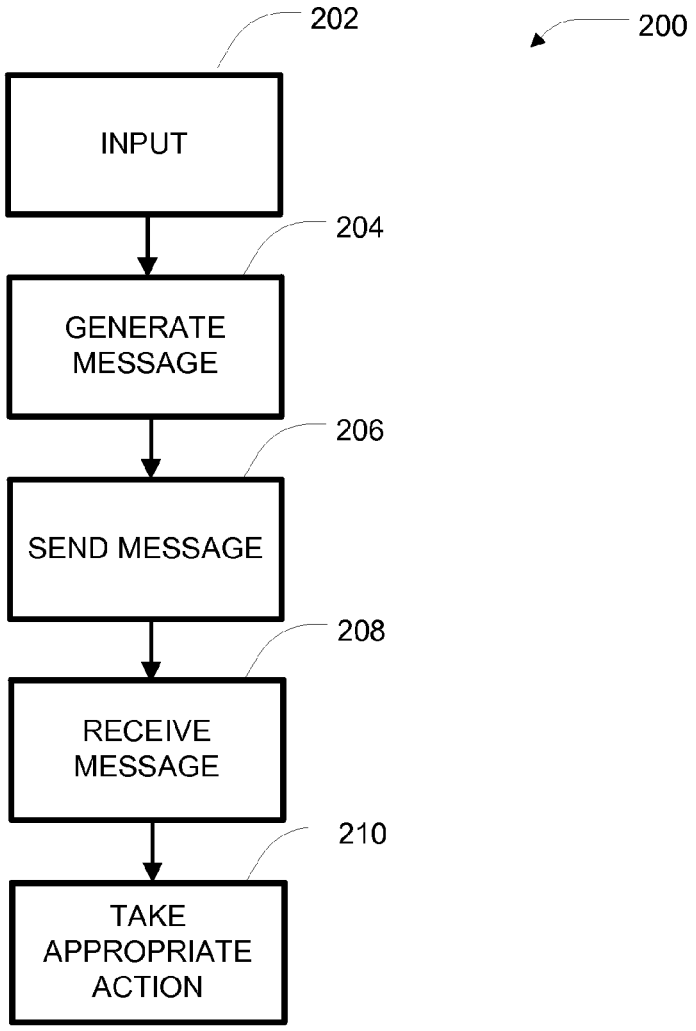
FIG. 5 is a flowchart of a method of controlling an electronic device using an audio accessory according to some embodiments.

Turning now to FIG. 5, illustrated therein is a method 200 of controlling an electronic device (e.g. electronic device 12) using an audio accessory (e.g. headset accessory 14) according to some embodiments.

At step 202, an input is received by the audio accessory. For example, a user may press one of the buttons 22, 24, 26 on the user control interface 20 of the audio accessory 14.

At step 204, a message (e.g., an out-of-audible band control message, which may include a header message) is generated based on the input received at step 202. For example, the tone generator 28 may generate a particular ultrasonic control message with a certain frequency (e.g., 100 kHz, 150 kHz) that is selected based on the particular button 22, 24, 26 that was pressed.

At step 206, the control message is sent to an electronic device, for example, over the microphone line of the audio accessory 14. In some cases, a header message may precede the control message.

At step 208, the electronic device receives the control message, which causes at least one resonator to resonate, triggering a corresponding response (e.g., waking up a processor, etc.)

At step 210, the action corresponding to the received input can be executed. For example, the electronic device 12 may increase or decrease audio volume depending on the particular input made at step 202.

Turning now to another aspect, in some cases, an electronic device may detect the presence of particular types of audio accessories using two different voltages, one voltage below and one voltage above a certain threshold (as determined by an internal reference voltage in audio accessory).

When an electronic device is operating in a low power mode in which some functionality is turned off, disabled, scaled back or is otherwise consuming less power, it can be useful to know if a key or button on the audio accessory has been pressed. More particularly, depressing a button on the audio accessory may "wake up" the electronic device and take it out of low power mode.

In some cases, detection of a specific button press (e.g., the microphone button) on the audio accessory may be accomplished by checking if a short is made between the two microphone terminals, and using a high value resistor as a bias resistor to limit power consumption. However, it may be desirable that pressing other buttons (e.g., the volume buttons) could also wake up the electronic device. However, in such other buttons are often active buttons, and in some cases this would lead to high power consumption on the electronic device, which is undesirable in lower power mode.

In some cases, it may be possible to detect whether particular buttons have been pressed using another technique, which may result in significant power reduction.

More particularly, when power is applied to the audio accessory, a special "power-on" sequence can be seen (such as an inaudible short period tone followed by another one with slightly longer period). This technique can allow the electronic device to determine what kind of audio accessory is inserted (e.g., by comparing the observed "power-on" sequence to one or more known profiles).

Furthermore, this "power-on" sequence (which occurs whenever the audio accessory is powered up), may also been seen in other circumstances, such as when a button on the audio accessory has been pressed and before applying power. More specifically, if a keypress is made before power is applied to the audio accessory, the start-up sequence (e.g., including two inaudible tones with different periods) may appear when the key is released. Therefore, if the electronic device pulses the audio accessory with a relatively low repetition rate (say at 5 Hz), but at a speed that is quicker than the minimum duration of a normal finger press of a button (which may have a duration of at least 250 ms, for example), it should be possible to reliably detect the button presses, even if the audio accessory has been powered down between the button presses.

In sum, a low duty cycle (e.g. 5 Hz) may be used to power the audio accessory microphone, while other special characteristics may be used to detect button presses under these conditions.

Stated another way, this technique supports detection of "special" frequency bursts from a special audio accessory to determine that such an audio accessory is connected to the device. If such a special audio accessory is present, the electronic device can listen for these bursts at a relatively low frequency to determine when particular buttons on the audio accessory are pressed.

Thus, the electronic device may "power up" the audio accessory intermittently (e.g., at 5 Hz) to permit sensing of the buttons, while still reducing overall power consumption on the electronic device.

In general, to make this work, it may be advisable to use a minimum pulse length selected so that the audio accessory has enough time to fully power up during these pulses. However, it may be possible to make a good engineering compromise between short pulse length and slow pulse repetition rate, and thereby significantly reduce the power consumption.

In some embodiments, the pulse length may be 20 ms, while the pulse repetition rate may be every 200 ms. This embodiment should be capable of achieving a current consumption of around 160 μA, or less, which is generally considered insignificant as compared to other functions of the electronic device.

Therefore, in some cases this method can be enabled for extended periods of time while consuming relatively small amounts of power. For example, the method may be constantly enabled unless the electronic device is in an "audio playback" mode, in which case it may make more sense to enable the entire microphone detection circuit all the time, in order to avoid any coupling between microphone line and headphone due to shared impedances and the pulsed power.

In some embodiments, these detection modes may optionally be enabled only when a particular type of special accessory is detected to further reduce power further.

In some cases, it may be beneficial to keep a pulse length of at least some minimum duration (such as 8 ms) in order be sure to detect high frequency tones that may arrive at some delayed time after power-on. As an alternative, an inaudible spectrally shaped detection pulse could be used to reduce the coupling in this mode.

Figure 6:
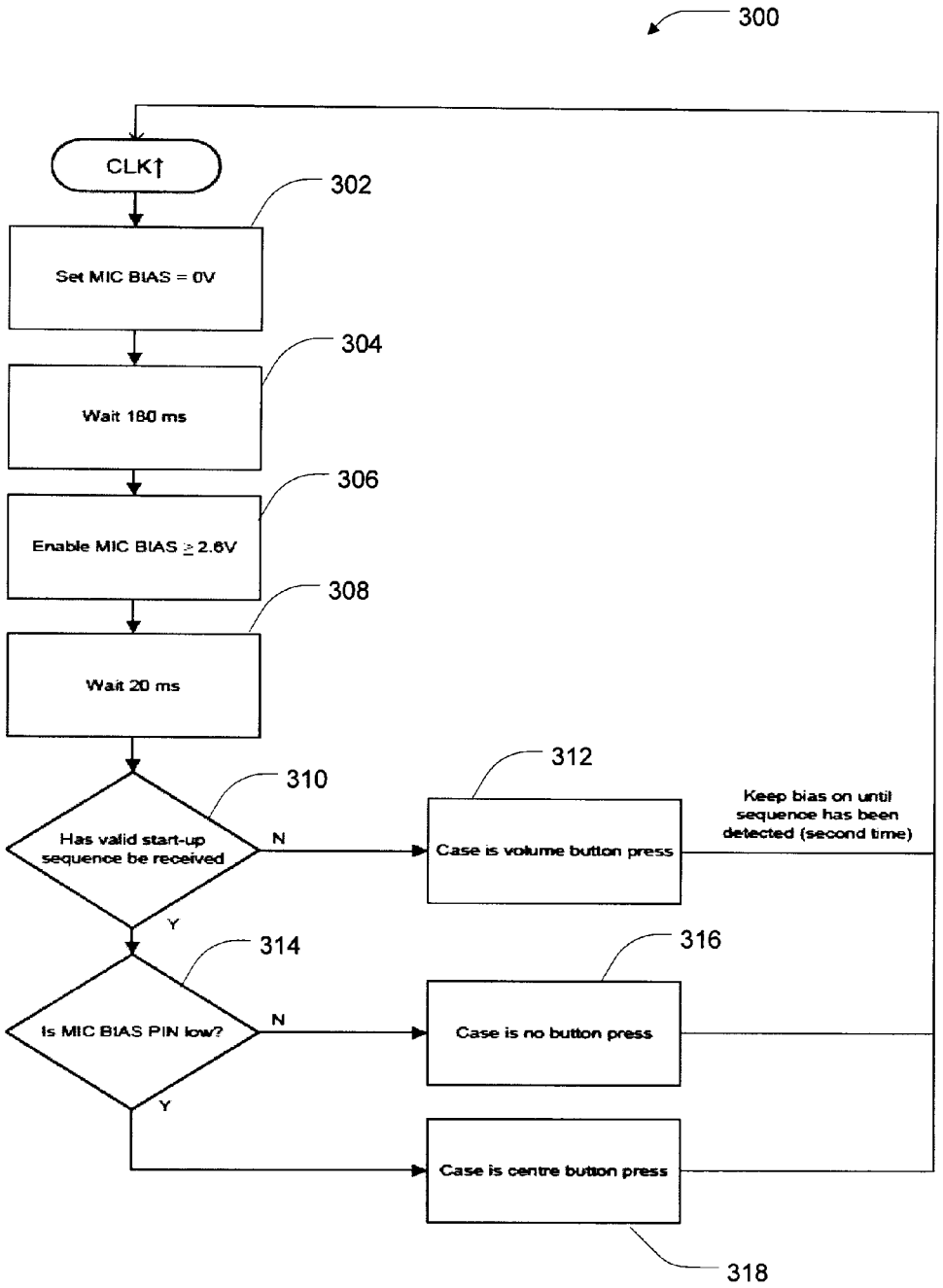
FIG. 6 is a flowchart of a method of detecting button presses on an audio accessory.

Turning now to FIG. 6, in this embodiment a method 300 of detecting button presses involves setting the microphone bias to 0 volts at step 302.

At step 304, the method waits a particular delay period (e.g., 180 ms).

At step 306, after the delay period, the microphone bias is powered on (e.g., set to at least 2.6 Volts).

At step 308, the microphone bias is maintained in the powered state for a minimum pulse length (e.g., 20 ms).

At step 310, a determination is then made as to whether a valid start-up sequence has been received by the electronic device. If no start-up sequence has been received, then at step 312 this indicates that a volume (or other button) may have been pressed. In such cases, the microphone bias can be kept active until the sequence has been detected.

However, if a start-up sequence is detected at step 310, then at step 314 a determination can be made as to whether the microphone bias pin has been set to a low value. If this has not happened, then at step 316 the method 300 may determine that no button has been pressed. On the other hand, however, if the microphone bias pin is not low, then at step 318 a determination can be made that another particular button has been pressed (e.g., a center button on the control interface).

Figure 7:
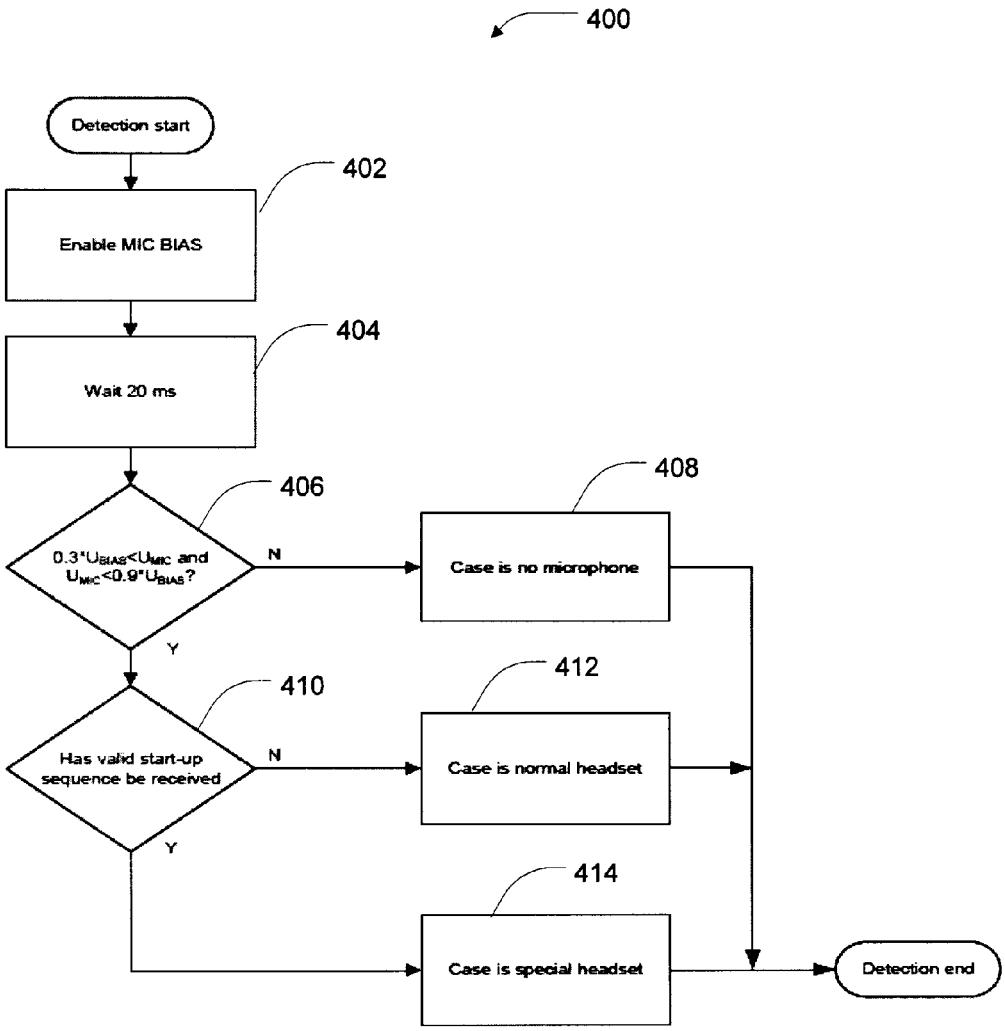
FIG. 7 is a flowchart of a method of detecting a type of audio accessory.

Turning now to FIG. 7, illustrated therein is a flowchart of a method 400 for detecting the particular type of audio accessory coupled to an electronic device in one embodiment.

At step 402, the microphone bias is enabled (e.g., the microphone bias is set to at least 2.6 Volts).

At step 404, this enabled microphone bias is kept active for a particular pulse duration (e.g., 20 ms).

At step 406, a determination is made as to whether the observed voltage falls within a particular range associated with the presence of a microphone on the audio accessory. If the observed voltage falls outside of this range, then at step 408 a determination is made that the particular audio accessory coupled to the electronic device does not include a microphone.

Otherwise, the method 400 proceeds to step 410, where a determination is made as to whether a valid start-up sequence has been received. If no such start-up sequence has been received, then at step 412 the method 400 determines that the particular audio accessory coupled to the electronic device is a "normal" audio accessory (i.e., an audio accessory that is not adapted to generate a particular start-up sequence).

Otherwise, the method 400 proceeds to step 414 and determines that the audio accessory is a "special" audio accessory, and which is capable of sending a particular start-up sequence.

In some embodiments, the method 400 may be performed before the method 300 is performed. More particularly, to save power in some embodiments the method 300 may only be performed when the method 400 determines at step 414 that the particular audio accessory coupled to the electronic device is a "special" audio accessory capable of providing corresponding button press information using the method 300.

Figure 8:
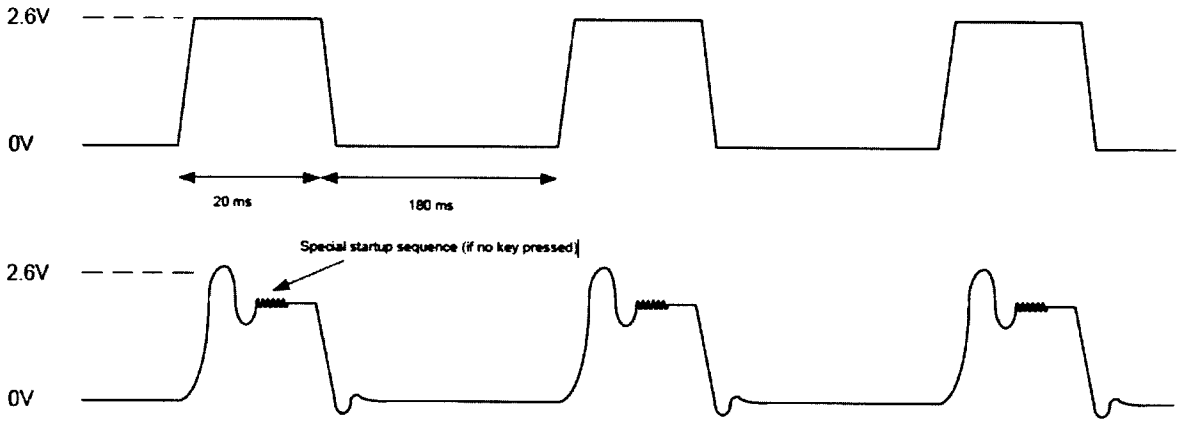
FIG. 8 is a timing diagram corresponding to the methods of FIGS. 6 and 7 according to one embodiment.

Finally, FIG. 8 shows a schematic image of a timing diagram corresponding to the start-up sequence for the methods as generally described with respect to FIGS. 6 and 7.

One or more embodiments may realize one or more benefits, some of which have been mentioned already. Some embodiments can be implemented in circuitry that has fairly small size and weight, which may be useful in devices and accessories that are handheld. The embodiments can be implemented in a variety of electronic devices. Many implementations combine noise handling and efficiency with error tolerance; for example, some resonating elements may respond to frequencies that deviate slightly from the nominal frequency.

The foregoing aspects of the method and the electronic device are provided for exemplary purposes only. Those skilled in the art will recognize that various changes may be made thereto without departing from the scope of the method and the electronic device as defined by the appended claims.

The invention claimed is:

1. A system for controlling an electronic device, the system comprising:

an audio accessory coupled to the electronic device, the audio accessory having a tone generator and a user control interface for receiving at least one input, the accessory adapted to, in response to receipt of an input, generate a corresponding header message at a particular frequency using the tone generator, and send that header message to the electronic device, the header message indicating that a control message will be sent and that a secondary detection circuit should be powered up to receive the control message;

the electronic device being operable to receive the header message, and including at least one resonator adapted to resonate at the particular frequency and to generate a corresponding output signal;

wherein the output signal causes the secondary detection circuit of the electronic device to power up to receive the control message; and wherein the electronic device is adapted to operate in a low power mode until the header message is detected, and then in a high power mode to detect the control message.

2. The system of claim 1, wherein the particular frequency is selected so as to be inaudible to a human user.

3. The system of claim 1, wherein each resonator includes a passive resonating element.

4. The system of claim 3, wherein the passive resonating element includes a LC filter.

5. The system of claim 3, further comprising a filter adapted to filter the message received by the resonating element.

6. The system of claim 1, further comprising a voltage comparator adapted to receive the output signal of the resonating element.

7. The system of claim 6, wherein the voltage comparator compares the output signal of the resonating element with a reference voltage to generate the output signal.

8. The system of claim 1, wherein the output signal of the resonator drives an interrupt line on a processor.

9. The system of claim 1, wherein the output signal is adapted to wake at least one component of the electronic device from a low power state.

10. The system of claim 1, wherein the at least one resonator includes a plurality of resonators, each resonator tuned to resonate at a different particular frequency indicative of a different corresponding header message.

11. The system of claim 1, wherein the header message has a constant frequency for each header message, and the control message frequencies vary for different control messages.

12. The system of claim 1, wherein the audio accessory is adapted to send the control message at various frequencies from 50 kHz to 500 kHz.

13. An electronic device adapted to be controlled by an audio accessory, comprising:

at least one resonator, each resonator tuned to respond to a respective particular frequency that corresponds to a respective particular header message generated by the audio accessory such that when the respective particular header message is received, the resonator resonates to generate a corresponding output signal that controls the electronic device;

a processor configured to:

operate in a low power mode until the corresponding output signal is detected; and switch into a higher power mode when the corresponding output signal is detected; and a secondary detection circuit configured to power up to receive a control message from the audio accessory when the processor is operating in the higher power mode, wherein the control message causes an action to be taken by the electronic device.

14. The electronic device of claim 13, wherein each resonator includes a passive resonating element.

15. The electronic device of claim 14, wherein the passive resonating element includes a LC filter.

16. The electronic device of claim 14, further comprising a filter adapted to filter the message received by the resonating element.

17. The electronic device of claim 14, further comprising a voltage comparator adapted to receive the output signal of the resonating element.

18. The electronic device of claim 13, wherein the particular frequency is selected so as to be inaudible to a human user.

19. The system of claim 18, wherein the audio accessory is adapted to send the control message at various frequencies from 50 kHz to 500 kHz.

20. A system for controlling an electronic device, the system comprising:

an audio accessory coupled to the electronic device, the audio accessory having a tone generator and a user control interface for receiving at least one input, the accessory adapted to, in response to receipt of an input, generate a corresponding header message at a particular frequencies using the tone generator, and send the corresponding header message to the electronic device, wherein the corresponding header message indicates that a control message will be sent;

the electronic device being operable to receive the header message, and including at least one resonator adapted to resonate at the particular frequency and to generate a corresponding output signal;

wherein the output signal causes an appropriate action to be executed on the electronic device; and wherein the header message has a constant frequency for each header message, and the control message frequencies vary for different control messages.

* * * * *